US007937851B2

(12) United States Patent
Rajagopalan et al.

(10) Patent No.: US 7,937,851 B2
(45) Date of Patent: May 10, 2011

(54) PROCESS FOR TREATMENT OF BIOMASS FEEDSTOCKS

(75) Inventors: Srinivasan Rajagopalan, Lansing, MI (US); Tonya Tiedje, Holt, MI (US); Darold McCalla, East Lansing, MI (US)

(73) Assignee: Michigan Biotechnology Institute, Lansing, MI (US)

( * ) Notice: Subject to any disclaimer, the term of this patent is extended or adjusted under 35 U.S.C. 154(b) by 180 days.

(21) Appl. No.: 11/719,158

(22) PCT Filed: Nov. 9, 2005

(86) PCT No.: PCT/US2005/040540

§ 371 (c)(1),
(2), (4) Date: May 11, 2007

(87) PCT Pub. No.: WO2006/055362

PCT Pub. Date: May 26, 2006

(65) Prior Publication Data

US 2009/0098251 A1 Apr. 16, 2009

Related U.S. Application Data

(60) Provisional application No. 60/627,259, filed on Nov. 12, 2004.

(51) Int. Cl.
*F26B 3/00* (2006.01)
*F26B 21/06* (2006.01)

(52) U.S. Cl. ..... 34/357; 34/405; 34/470

(58) Field of Classification Search ..... 34/329, 34/357, 405, 406, 407, 467, 468, 470, 72, 34/73, 92

See application file for complete search history.

(56) References Cited

U.S. PATENT DOCUMENTS

| | | | | |
|---|---|---|---|---|
| 4,356,196 | A | 10/1982 | Hultquist | |
| 5,171,592 | A | 12/1992 | Holtzapple et al. | |
| 6,106,888 | A | 8/2000 | Dale et al. | |
| 6,176,176 | B1 | 1/2001 | Dale et al. | |
| 6,255,505 | B1 * | 7/2001 | Bijl et al. | 554/227 |

FOREIGN PATENT DOCUMENTS

EP 1533279 A1 * 5/2005

* cited by examiner

*Primary Examiner* — Jiping Lu
(74) *Attorney, Agent, or Firm* — Dickinson Wright PLLC

(57) ABSTRACT

A method and apparatus for continuously treating a moist biomass feedstock is disclosed. The method includes treating a biomass feedstock with a swelling agent in a pressurized first vessel, transferring the feedstock to a second vessel at a lower operating pressure than the first vessel such that the biomass fibers rupture. At least portions the swelling agent, and/or the moisture are recycled in the process.

5 Claims, 4 Drawing Sheets

PROCESS FOR TREATMENT OF BIOMASS FEEDSTOCKS

CROSS REFERENCE TO RELATED APPLICATIONS

This application claims priority under 35 U.S.C. §119(e) of U.S. Provisional Application Ser. No. 60/627,259, filed on Nov. 12, 2004, the disclosure of which is herein incorporated by reference.

STATEMENT OF GOVERNMENT INTEREST

This invention was made with Government support under Specific Cooperative Agreement No. 58-5447-2-315 awarded by the United States Department of Agriculture, Agricultural Research Service. The Government has certain rights in the invention.

BACKGROUND

Biomass materials such as corn stover, wheat straw, alfalfa, grasses, rice straw, corn fiber, distiller's dried grains with solids, switchgrass, bagasse, and the like contain cellulosic material and proteins that may be used in fermentation processes, as animal feeds, or for other purposes. However, the availability of these materials is low in untreated biomass material. Various processes and pretreatments of biomass material have been used to increase the availability of useful materials in biomass. These processes include dry milling, wet milling, steam explosion, and chemical pretreatment such as the ammonia fiber explosion (AFEX) process.

These processes have several drawbacks. Dry milling is less effective for increasing the availability of the cellulosic materials and proteins in biomass material than other techniques. Wet milling, while more effective than dry milling, incurs greater energy costs which limits the economic feasibility of the process. Also, continuous steam explosion processes are energy intensive and require additional separation steps to recover volatile organics that are stripped from the biomass by the steam. The AFEX process, however, is a unique chemical pretreatment.

Up to now, the AFEX process has been primarily carried out as a batch process, which limits the ability to commercially apply the process. In the AFEX process, the biomass material is typically contacted with liquid ammonia at an elevated pressure for a sufficiently long time for the ammonia to swell the biomass material. After the biomass fibers have been swollen with liquid ammonia, the pressure may be rapidly decreased to a level below the vapor pressure of the ammonia such that the ammonia vaporizes and ruptures the biomass fibers. This makes more of the cellulosic material and proteins available for down stream processes or for animal feed.

Attempts to create a continuous AFEX process have shown that the swelling process may be carried out in extrusion reactors. However, these attempts have not effectively provided for the efficient recovery and recycle of the ammonia used to swell the biomass fibers. According to some designs, the ruptured biomass is dried and the vapor containing swelling agent and water is condensed and distilled so that purified swelling agent may be recycled to the reactor. This distillation process is expensive, both in capital expense, and in energy costs.

Accordingly, there is a need for a continuous AFEX process that is more commercially feasible than prior designs. Further, there is a need for a continuous AFEX process that provides for the effective recovery and purification of vaporized ammonia. Further still, there is a need for a continuous AFEX process that provides for efficient recovery of the portion of ammonia that remains with the biomass after the rapid depressurization.

It would be desirable to provide a system and/or method that provides one or more of these or other advantageous features. Other features and advantages will be made apparent from the present specification. The present application is directed to those processes and embodiments disclosed herein, regardless of whether they accomplish one or more of the aforementioned needs.

SUMMARY

The invention relates to processes for increasing the availability of cellulosic and other materials in biomass feedstocks. In particular, the invention relates to processes that use a swelling agent to rupture fibrous biomass materials to increase the availability of cellulosic and other materials are described.

One embodiment relates to a method for continuously treating biomass material. The method includes contacting the biomass material and a swelling agent in a first vessel under a pressure at least as great as the vapor pressure of the swelling agent and for a time sufficient to allow the swelling agent to swell fibers within the biomass material. The biomass may then be transferred to a second vessel with an outlet and having a pressure sufficiently less than that of the first vessel such that a portion of the swelling agent vaporizes and exits the second vessel through a vapor outlet, causing the biomass fibers to rupture. The ruptured biomass may then be dried to provide a vapor stream and a dry biomass. The vapor stream is then condensed, and used to treat the biomass material before the biomass material enters the first vessel.

Another embodiment relates to a method for continuously treating biomass material. The method includes contacting the biomass material and a swelling agent in a first vessel under a pressure at least as great as the vapor pressure of the swelling agent and for a time sufficient to allow the swelling agent to swell fibers within the biomass material. The biomass material may then be transferred to a second vessel having a pressure sufficiently less than that of the first vessel such that a portion of the swelling agent rapidly vaporizes, causing the biomass fibers to rupture. The first vessel is pressurized with a stream including vaporized swelling agent to a pressure sufficient to prevent vaporization of the liquid swelling agent in the first vessel.

Another embodiment relates to an apparatus for continuously treating moist biomass material with a swelling agent. The apparatus includes a first vessel capable of operating at a pressure greater than an ambient pressure wherein the biomass material is in contact with a liquid form of the swelling agent for a sufficient time to swell the biomass material. The apparatus also includes a second vessel, coupled to the first vessel, and capable of operating at a pressure sufficiently lower than the pressure of the first vessel to allow at least a portion of the swelling agent to vaporize. The apparatus also includes a drying section including a dryer, wherein at least a portion of the remaining moisture and swelling agent may be removed from the biomass, condensed, and recycled.

Yet another embodiment relates to an apparatus for continuously treating biomass material with a swelling agent. The apparatus includes a first vessel capable of operating at a pressure greater than an ambient pressure wherein the biomass material is in contact with a liquid form of the swelling agent for a sufficient time to swell fibers of the biomass material. The apparatus also includes a second vessel, coupled to the first vessel, and operated at a pressure sufficiently lower than the pressure of the first vessel to allow at least a portion of the swelling agent to vaporize. The first vessel is capable of being pressurized by a first stream of vaporized swelling agent.

It is to be understood that both the foregoing summary of the invention and the following detailed description are of exemplary embodiments, and not restrictive of the invention or other alternative embodiments of the invention.

DETAILED DESCRIPTION OF EXEMPLARY EMBODIMENTS

Figure 1:
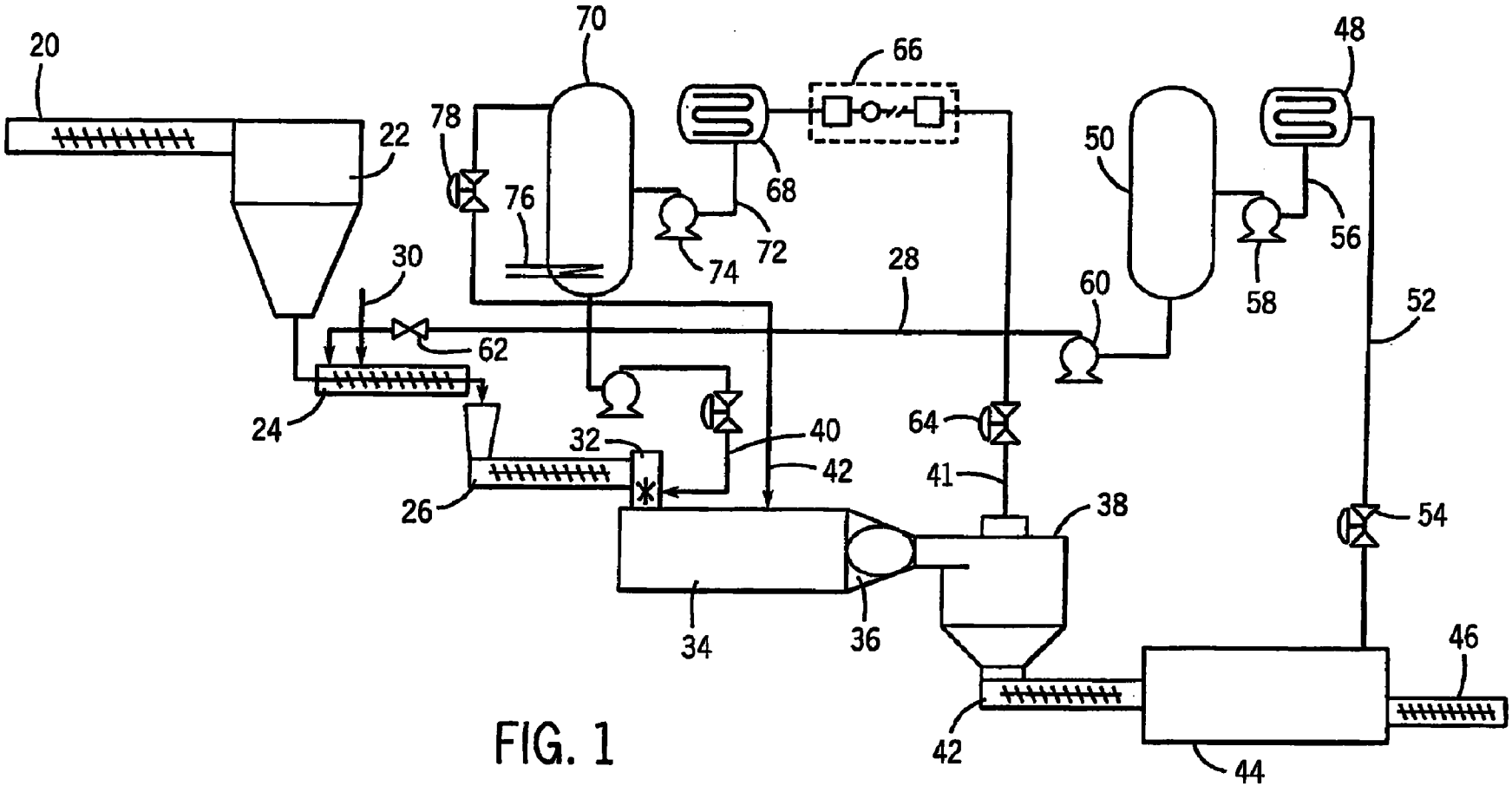
FIG. 1 is a schematic drawing of one example of the continuous biomass treatment process.

The process may include a pressurized reactor in which biomass material is contacted with a swelling agent. The reactor generally includes at least one inlet and one outlet. The inlet receives a mixture of moist biomass material and liquid swelling agent. Alternatively, the reactor may include separate inlets for the moist biomass and the liquid swelling agent. An additional inlet may be provided for pressurizing the reactor vessel with swelling agent vapor to at least about the vapor pressure of the swelling agent at the operating temperature of the reactor to prevent vaporization of the liquid swelling agent. This may reduce the amount of liquid swelling agent needed in the inlet streams, which in turn may reduce material costs. The reactor vessel is desirably configured to provide a residence time sufficient to allow the liquid swelling agent to swell the biomass material.

The biomass material is transferred from the reactor to a second vessel which is generally operated at a lower pressure than the reactor vessel. The second vessel may be a flash tank with an inlet for the reactor outlet stream, a vapor outlet, and a bottoms outlet for the biomass material and remaining liquid. The pressure of the flash tank is sufficiently less than that of both the reactor and the vapor pressure of the swelling agent to allow for the rapid vaporization of the swelling agent that has swollen the biomass such that the biomass fibers are ruptured. The flash tank may be pressurized and operated at a temperature such that the vapor stream is substantially composed of a swelling agent and, in some embodiments, is a relatively pure swelling agent vapor. This configuration, unlike depressurizing the reactor outlet to ambient pressure, allows for the recovery of a relatively pure swelling agent stream that may be condensed and recycled.

The ruptured biomass material is then commonly dried. The vapor driven off of the ruptured biomass material generally includes swelling agent and water. This vapor may be condensed and recycled in the process, e.g. the recycled vapor can be used to presoak the biomass material before it enters the reactor.

FIGS. 1-3 and 5 show one example of an embodiment of the present process. Referring to FIGS. 1, 2, 3, and 5, system 10 includes intake section 12, treatment section 14, drying section 16, and recovery section 18. Intake section 12 includes conveyor 20, storage bin 22, presoak conveyor 24, and feeder 26. Conveyor 20 transports a biomass feedstock to storage bin 22 where the biomass is accumulated to provide a continuous stream into the rest of system 10. The biomass may include corn stover, wheat straw, alfalfa, grasses, rice straw, corn fiber, distiller's dried grains with solids, switchgrass, bagasse, other such materials, or mixtures of these materials. In some embodiments, the biomass feedstock may have sufficient water or aqueous ammonia added to adjust the moisture content from about 20 to upwards of 75% on a weight basis. In some of these embodiments, the biomass feedstock may have a moisture content up to about 50% on a weight basis. According to some embodiments, presoak conveyor 24 may be operated at temperatures ranging from about 25° C. to about 90° C. Also, in some embodiments, presoak conveyor 24 may be operated at pressures ranging from about 1 atm and about 10 atm.

According to an exemplary embodiment, feeder 26 is a reciprocating plug feeder. Alternatively, other feeders, such as extruders, that are capable of feeding the solid biomass feedstock to a pressurized vessel may be used. The biomass may be milled to a suitable size for use in the equipment. According to an exemplary embodiment, the biomass is milled to a grain size of 3 to 5 millimeters. Alternatively, the biomass material may be milled such that it can pass a 40 mesh screen. The conveyors used may be belt conveyors, augers, or other suitable devices. Presoak conveyor 24 transports the biomass from storage bin 22 to feeder 26. The biomass is soaked with a mixture of swelling agent and water supplied by stream 28 and make up stream 30 to make the biomass feedstock suitable for use in feeder 26 such that the soaked biomass feedstock serves to seal the inlet of the reactor to prevent leaks.

According to an exemplary embodiment, the swelling agent includes liquid ammonia. Alternatively, other volatile chemicals suitable for the fiber explosion process could be used. Further, the biomass feedstock may be presoaked with either water or swelling agent alone. Feeder 26 transports the soaked biomass feedstock to treatment section 14.

Treatment section 14 includes transition chamber 32, reactor 34, transporter 36, and vessel 38. The biomass feedstock enters transition chamber 32 from feeder 26. Stream 40 includes liquid swelling agent and flows into transition chamber 32 where stream 40 and the soaked biomass feedstock are combined prior to being introduced into reactor 34. Reactor 34 may be pressurized. Alternatively, the liquid swelling agent and feedstock may be introduced into reactor 34 separately. Reactor 34 may be an extrusion reactor. Alternatively, reactor 34 may be a digester or other suitable device. According to an exemplary embodiment, reactor 34 is made of stainless steel, such as type 316 stainless steel. Alternatively, reactor 34 may be made of other materials suitable for use with the swelling agent. Reactor 34 may be pressurized with vaporized swelling agent supplied by stream 42.

The operating pressure of reactor 34 is desirably at or above the vapor pressure of the swelling agent to prevent vaporization of the liquid swelling agent supplied by stream 40. According to an exemplary embodiment, reactor 34 may be operated at pressures between about 90 psia and about 350 psia. Alternatively, reactor 34 may be operated at other sufficiently high pressures. In some embodiments reactor 34 may be operated at pressures of at least about 250 psig. According to some embodiments, reactor 34 may be operated within a temperature range of about 50° C. to about 100° C. Temperatures ranging from about 70° C. to about 90° C. may be particularly suitable for the operation of reactor 34. The reactor is sized to provide a residence time adequate for the biomass to absorb an amount of the liquid swelling agent sufficient to carryout fiber explosion. Typical residence times in the reactor can range from about 5 minutes to about 30 minutes.

Transporter 36 moves the swollen biomass from an outlet of reactor 34 to vessel 38. Transporter 36 is shown as a rotary release (a.k.a. pocket) valve; however, other devices suitable for transporting the swollen biomass from pressurized reactor 34 to vessel 38, such as extruders may be used. According to an exemplary embodiment, transporter 36 is made of stainless steel, such as type 316 stainless steel. Alternatively, transporter 36 may be made of other materials suitable for use with the swelling agent.

Vessel 38 is operated at a pressure sufficiently less than the operating pressure of reactor 34 such that a portion of the liquid swelling agent rapidly vaporizes causing fibers of the biomass material to rupture. Typically, vessel 38 may be operated at pressures ranging from about 1 atm to about 2 atm. According to an exemplary embodiment, vessel 38 is a flash tank. Further, Vessel 38 is made of type 316 stainless steel. Alternatively, vessel 38 may be made of other materials suitable for use with the swelling agent. Vessel 38 may be operated at a temperature and pressure such that the vapor stream 41 consists essentially of pure swelling agent. In some embodiments, vessel 38 may be operated at a pressure ranging from about 10 psig to about 30 psig. Also, in some embodiments, vessel 38 may be operated at a temperature ranging from about 15° C. to about 35° C. In other embodiments, vessel 38 may be operated at temperatures ranging from about 35° C. to about 60° C. Vapor stream 41 flows to recovery section 18. The bottoms stream of vessel 38 includes moist, ruptured biomass and a quantity of liquid swelling agent that did not vaporize in vessel 38. The bottoms stream flows to drying section 16.

Drying section 16 includes feeder 42, dryer 44, conveyor 46, condenser 48, and tank 50. The bottoms stream of vessel 38 is carried by feeder 42 to dryer 44. According to an exemplary embodiment, dryer 44 may be an indirect rotary dryer. Alternatively, other types of dryers may be used. Typically, dryer 44 is operated under a partial vacuum with operating pressures ranging from about 0.1 atm to about 0.9 atm. In some embodiments, the dryer may be operated at an ambient pressure. Dryer 44 may be operated at temperatures operated from about 50° C. to about 100° C. Dryer 44 vaporizes a portion of the remaining swelling agent and moisture in the ruptured biomass material. The dried, ruptured biomass material is removed by conveyor 46 as the product of the pretreatment process. The product may be used for downstream processes including but not limited to enzymatic hydrolysis, fermentation, or as a ruminant animal feed. The vapors produced by dryer 44 form stream 52 which is regulated by valve 54.

Stream 52 flows to condenser 48. A liquid stream 56, containing water and swelling agent is moved to tank 50 by pump 58. According to one embodiment, tank 50 may be made of 316 stainless steel. Alternatively, tank 50 may be made of other materials suitable for use with the swelling agent. Pump 60 draws liquid from tank 50 into stream 28 which in turn is used to presoak the biomass feed at presoak conveyor 24. Valve 62 regulates the flow of stream 28. The use of the condensed vapors from dryer 44 to presoak the biomass before it enters feeder 26 allows for a recycle of the swelling agent and water in stream 28 without the need for costly separation processes such as distillation. This reduces energy and capital costs for the pretreatment process while maintaining a high level of swelling agent recovery.

As stated before, vapor stream 41 flows from vessel 38 to recovery section 18. The flow of vapor stream 41, and the pressure of vessel 38 is regulated by valve 64. Recovery section 18 includes compressor 66, condenser 68, and swelling agent tank 70. Compressor 66 pressurizes the vapor of vapor stream 41. The compressed vapor stream flows to condenser 68 where the compressed vapor stream is condensed to a liquid stream 72. The liquid of stream 72 is moved to swelling agent tank 70 by pump 74.

The contents of swelling agent tank 70 may be heated by heater 76 such that the upper portion of swelling agent tank 70 contains vaporized swelling agent, while the lower portion of swelling agent tank 70 includes liquid swelling agent. The contents of swelling agent tank 70 may be under a pressure greater than the operating pressure of reactor 34. According to some embodiments, the contents of swelling agent tank 70 may be stored at temperatures ranging from about 0° C. to about 100° C. In some of these embodiments, the contents of swelling agent tank 70 may be stored a temperature about the operating temperature of reactor 34. In some embodiments, the contents of the swelling agent tank may be stored at pressures ranging from about 30 psia to about 1000 psia. Stream 42 includes vaporized swelling agent from the upper portion of swelling agent tank 70 and flows to reactor 34. Stream 40 includes liquid swelling agent from the lower portion of the swelling agent tank 70. Pump 80 moves the liquid swelling agent of stream 42 from swelling agent tank 70 to reactor 34 to transition chamber 32. Valve 82, which is on stream 40 between pump 80 and reactor 34, controls the flow of stream 40 into transition chamber 32.

Figure 2:
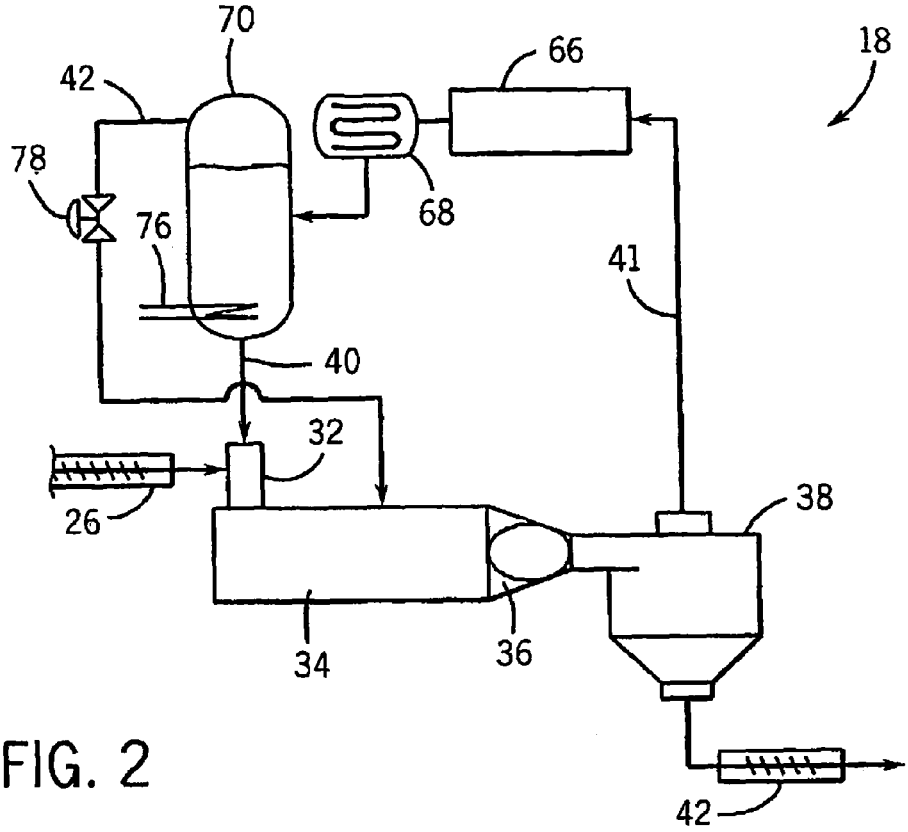
FIG. 2 is a schematic drawing of a portion of the process shown in FIG. 1, which includes an ammonia recovery system.

Referring to FIG. 2, which depicts a portion of system 10, recovery section 18 may include compressor 66, condenser 68, and swelling agent tank 70. Vapor stream 41 may extend from an outlet of vessel 38 to a compressor 66 which typically pressurizes the vapor stream. The vapor stream may then flow to condenser 68 which typically cools and condenses the vapor. The condensed vapor may then be placed in swelling agent storage tank 70. Swelling agent tank 70 may be heated by heater 76 to a temperature above that of the operating temperature of reactor 34. Swelling agent tank 70 may contain swelling agent in both the liquid and vapor phases at a pressure greater than that of the operating pressure of reactor 34. A vapor stream 42 may be drawn from swelling agent tank 70 and directed to an inlet in reactor 34. Valve 78, which may be a pneumatic valve or other suitable device, may be used to control the flow of swelling agent vapor to reactor 34. Using gaseous swelling agent to pressurize reactor 34 prevents vaporization of the liquid swelling agent fed to reactor 34. This may reduce the amount of liquid swelling agent needed and in turn may reduce costs. A liquid stream 40 may be drawn from swelling agent tank 70 to provide liquid swelling agent for reactor 34.

Figure 3:
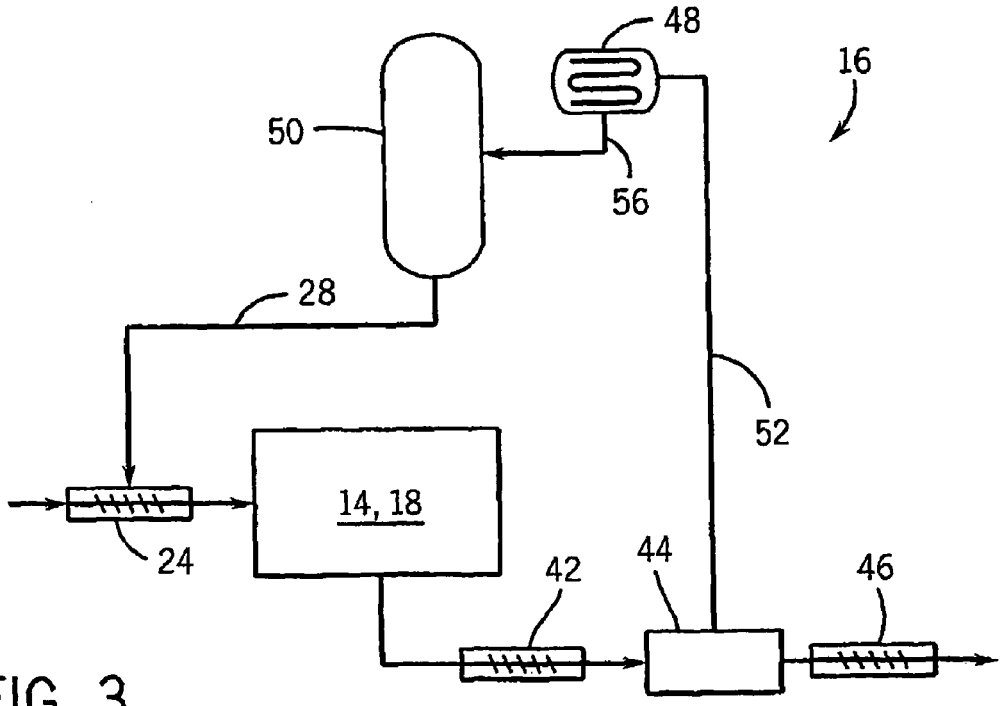
FIG. 3 is a schematic drawing of a portion of the process of FIG. 1, which includes a dryer and an associated swelling agent/water recovery system.

Referring to FIG. 3, which depicts a portion of system 10, drying section 16 may include feeder 42, dryer 44, conveyor 46, condenser 48, and tank 50. The ruptured biomass produced in treatment section 14 is moved to dryer 44 by conveyor 42. Dryer 44 removes a portion of the moisture and swelling agent from the ruptured biomass to provide a vapor stream including swelling agent and water, and a dry biomass. The dry biomass is not necessarily completely dry and may well contain water and/or swelling agent. The vapor generated by dryer 44 leaves dryer 44 as stream 52. Stream 52 flows to condenser 48. The condensed vapor exits condenser 48 as a liquid stream 56 containing swelling agent and water. The liquid condensate is accumulated in tank 50. Stream 28 includes liquid swelling agent and water, and flows from tank 50 to presoak conveyor 24 where the liquid is used to treat the biomass feedstock. The treated biomass exiting the dryer will typically have an ammonia content ranging from about 0% to about 2% based on a dry biomass basis. The treated biomass exiting the dryer may also have a moisture content ranging from about 0% to about 25%.

Figure 4:
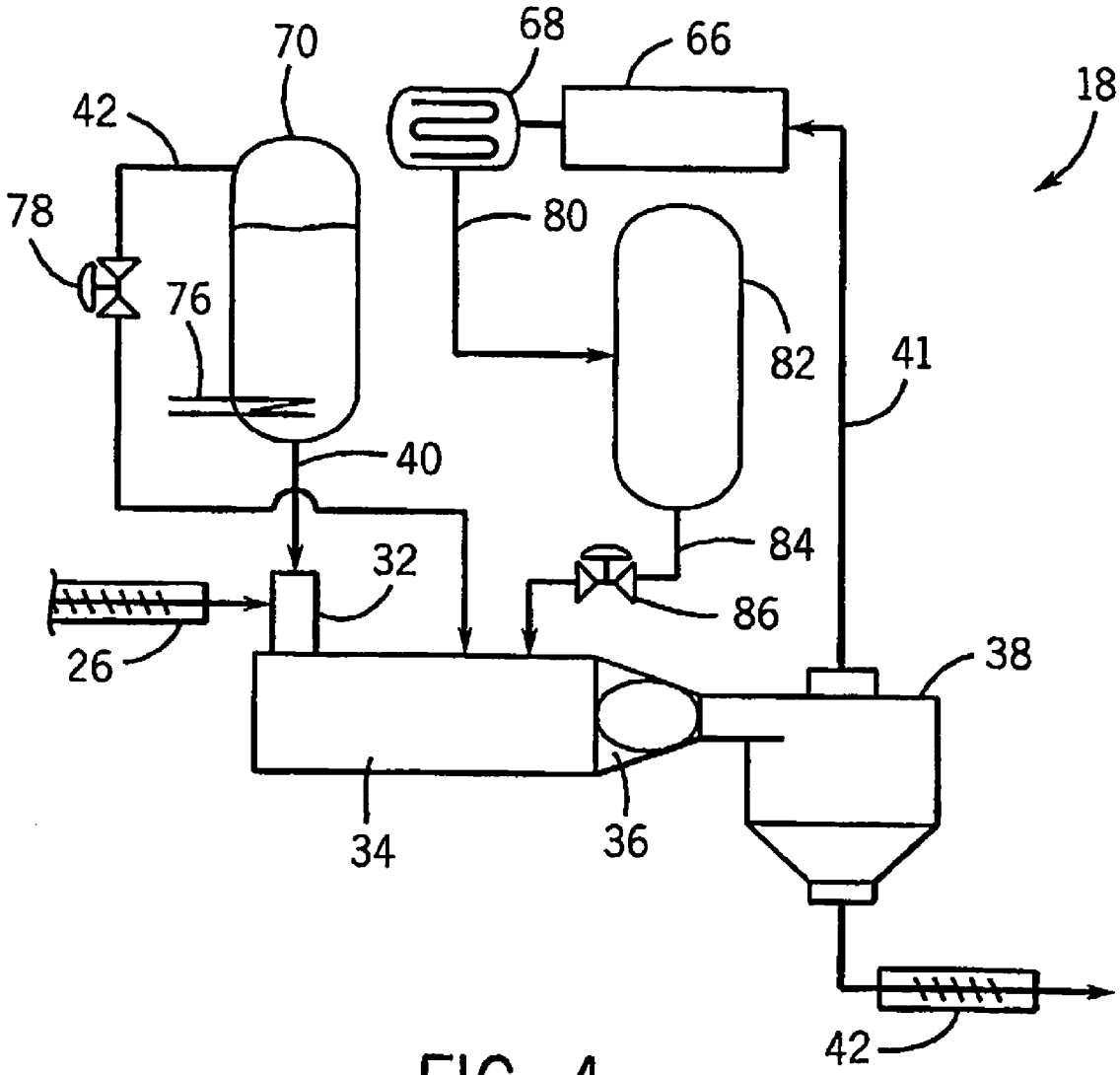
FIG. 4 is a schematic drawing of an alternative portion of the process of FIG. 1, which includes an ammonia recovery system.
Figure 5:
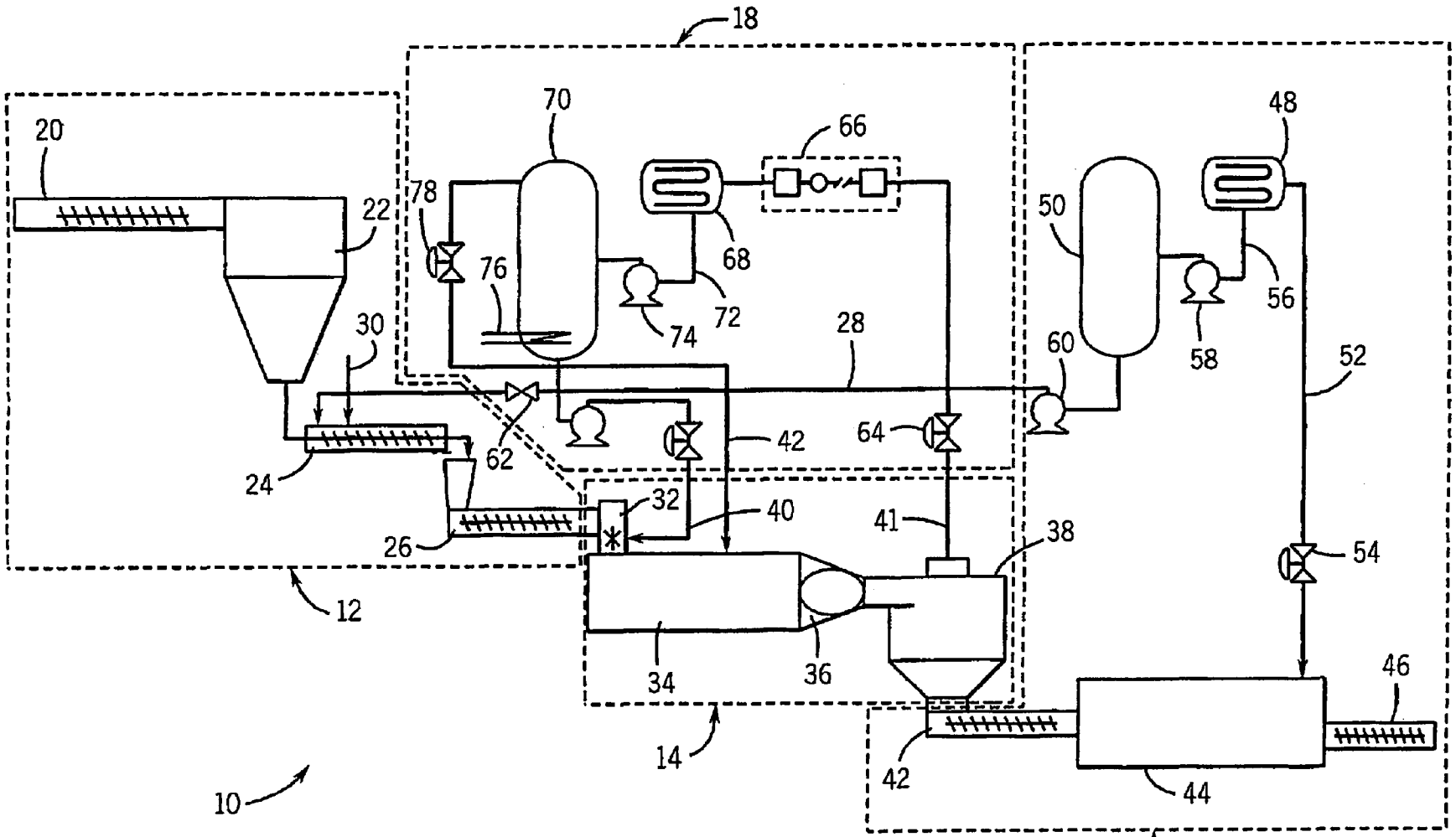
FIG. 5 is a schematic drawing of one example of the continuous biomass treatment process.
Figure 1:
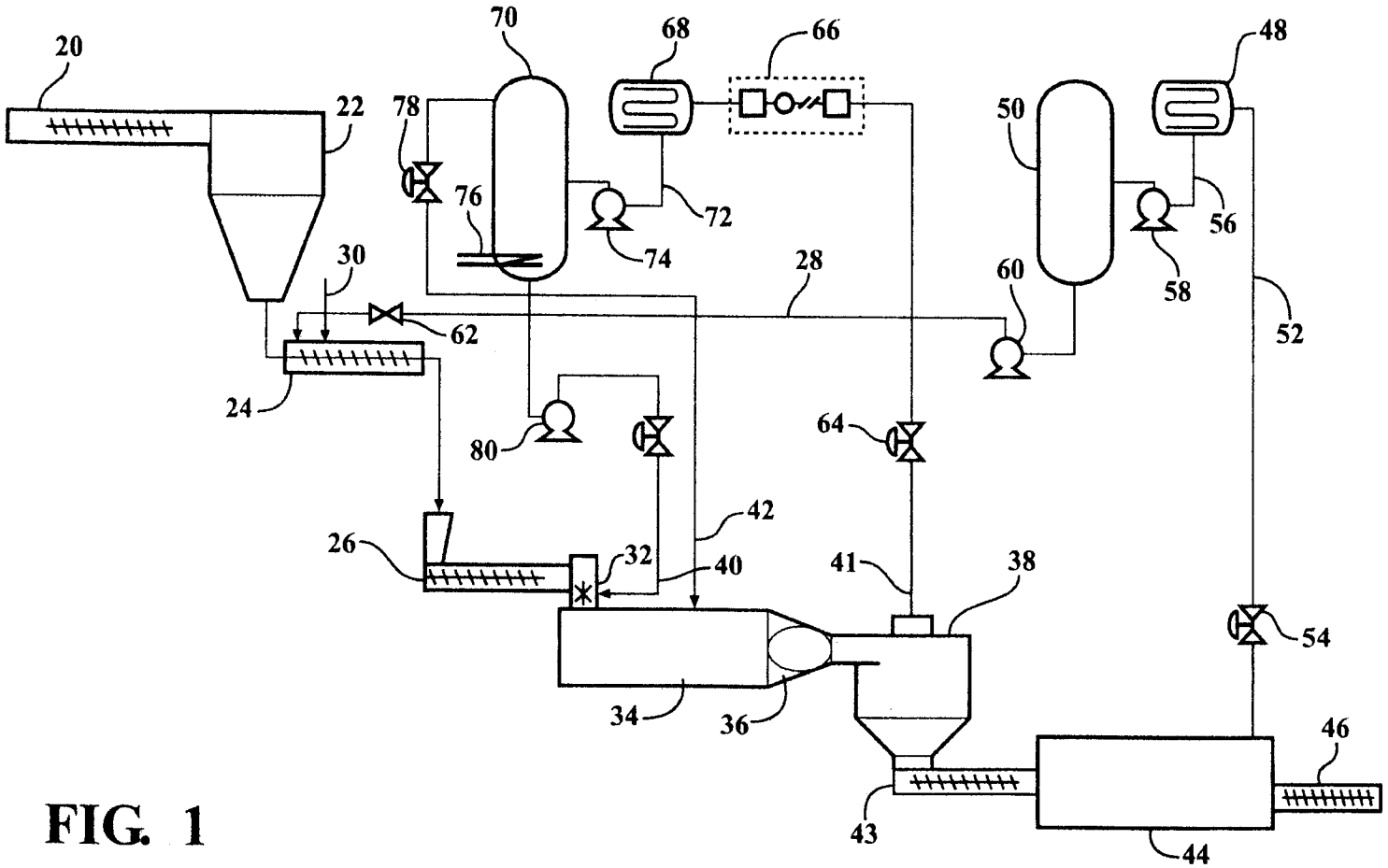
Figure 5:
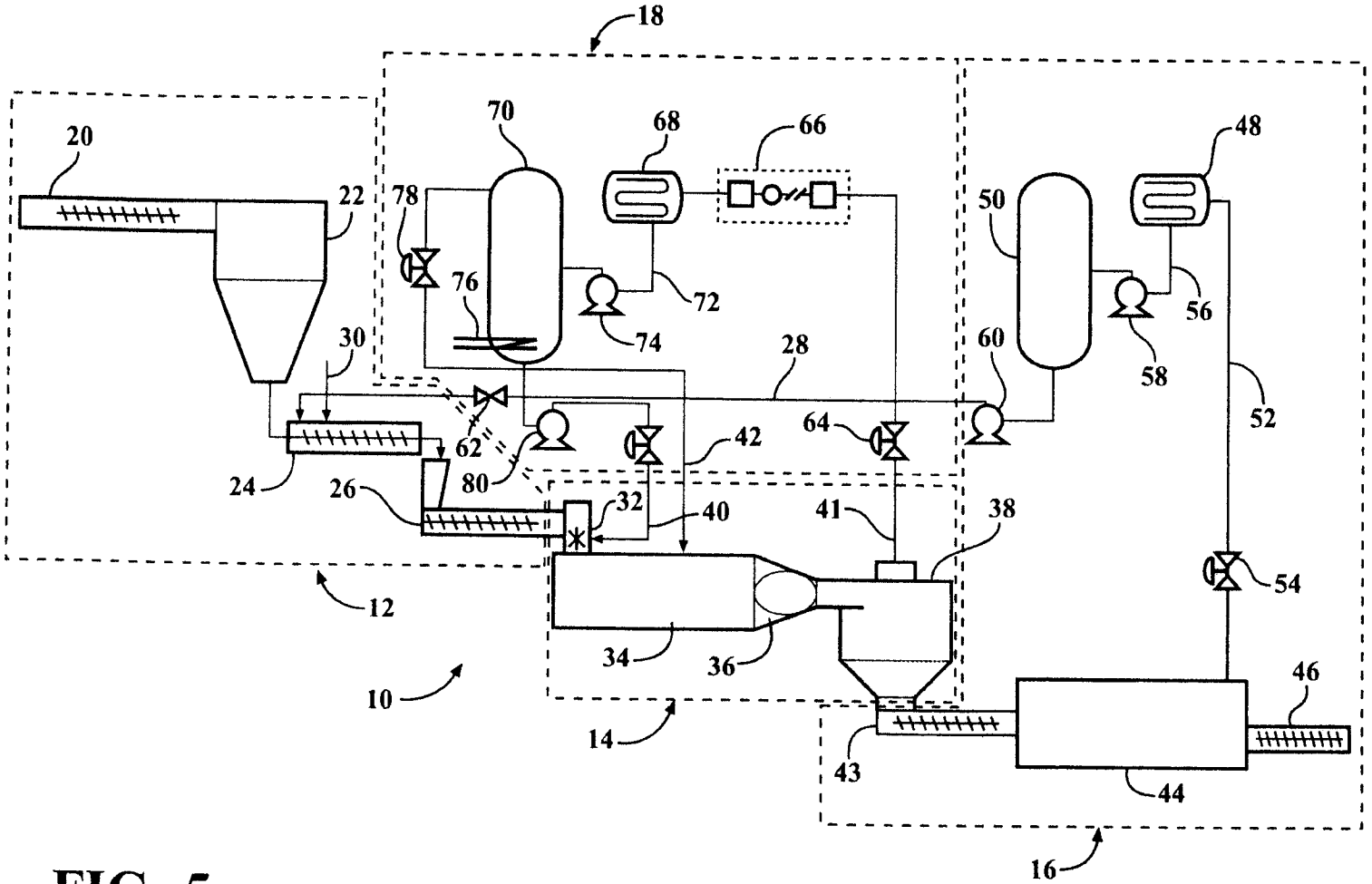

Referring to FIG. 4, which depicts an alternative embodiment of a portion of system 10, recovery section 18 may include compressor 66, condenser 68, swelling agent tank 70 and tank 82. Vapor stream 41 may extend from an outlet of vessel 38 to a compressor 66 which typically pressurizes the vapor stream. The vapor stream 41 may then flow to condenser 68 which typically cools and condenses the vapor. The condensed vapor may include swelling agent and water and may be placed in tank 82. Stream 84 flows from an outlet of tank 82 to an inlet on reactor 34 for supplying swelling agent to the reactor. The flow of stream 84 may be controlled by a valve 86. Alternatively, stream 84 may flow from tank 82 to presoak conveyor 24 (shown in FIG. 2).

EXAMPLES

The following examples are presented to illustrate the present invention and to assist one of ordinary skill in making and using the same. The examples are not intended in any way to otherwise limit the scope of the invention.

Example 1

Corn stover (94,444 kg/hr) with 10% moisture content can be continuously mixed with a recycled ammonia-water mixture (41,851 kg/hr ammonia and 109,594 kg/hr water) in a pre-soak conveyor. Steam (8,462 kg/hr) is added to adjust the dry biomass to water ratio to 1:1.5. The mixture is plug-fed into a pressurized AFEX reactor. 43,149 kg/hr dry ammonia is added from a storage tank to adjust the biomass to ammonia weight ratio to 1:1 (based on a biomass dry weight). The mixture is reacted at 90° C. for 5-30 min at a pressure of 20 atm.

Following the reaction, the mixture is transferred by a rotary release valve into a flash tank where it is flashed adiabatically until the final temperature drops to 40° C. and the final pressure reaches 1 atm. The flash vapor contains 42,885 kg/hr ammonia and 1,946 kg/hr water. The vapors are compressed to 8.5 atm and partially condensed. The residual water is removed in a flash condenser. The vapor is liquefied to ammonia in a second condenser and pumped to an ammonia storage tank.

Solids from the flash tank are dried in an indirect rotary dryer at 90° C. and under a partial vacuum of 0.6 atm. The dryer vapor, containing 41,851 kg/hr ammonia and 109,594 kg/hr water, is condensed at 1.4 atm and 30° C. and pumped to a ammonia-water storage tank. The treated biomass has 263 kg/hr ammonia and 15,960 kg/hr water.

Example 2

Corn stover (94,444 kg/hr) with 11% moisture can be continuously mixed with a recycled ammonia-water mixture (48,365 kg/hr ammonia and 80,879 kg/hr water) in a pre-soak conveyor at a temperature of 25-50° C. and a pressure of 30-200 psia. 37,177 kg/hr steam is added to adjust the biomass to water weight ratio to 1:1.5 (based on a biomass dry weight). The mixture is plug-fed into a pressurized AFEX reactor (e.g. a continuous digester). 36,635 kg/hr dry ammonia is added from a storage tank to adjust the dry biomass to ammonia ratio to 1:1. The mixture is reacted at 90° C. for 5-30 min at a pressure of 20 atm.

Following the reaction, the mixture is transferred by a rotary release valve into a flash tank where it is flashed adiabatically until the final temperature drops to 52° C. and the pressure drops to 2 atm. The flash vapor contains 35,304 kg/hr ammonia and 1425 kg/hr water. The vapors are compressed to 8.5 atm and partially condensed. The residual water is removed in a flash condenser. If desired, vapor may be liquefied to ammonia in a second condenser and pumped to an ammonia storage tank.

Solids from the flash tank are dried in an indirect rotary dryer at 70° C. and partial vacuum of 0.4 atm. The dryer vapor containing 48,365 kg/hr ammonia and 80,879 kg/hr water are condensed at 1.4 atm and 30° C. and pumped back to a ammonia-water storage tank. The treated biomass has 1329 kg/hr ammonia and 45,196 kg/hr water.

Illustrative Embodiments

In some embodiments, a method for continuously treating a moist biomass material, comprises rupturing a biomass material by vaporizing a swelling agent; drying the ruptured biomass material to provide a first vapor stream and a dried biomass; condensing the first vapor stream; and using the condensed first vapor stream to treat biomass material before the biomass material is ruptured.

In some of these embodiments, the step of rupturing the biomass material comprises contacting the biomass material and the swelling agent in a first vessel under a pressure at least as great as the vapor pressure of the swelling agent and for a time sufficient to allow the swelling agent to swell fibers within the biomass material.

According to some embodiments, the step of rupturing the biomass material further comprises transferring the biomass material to a second vessel having a pressure sufficiently less than that of the first vessel such that at least a portion of the swelling agent vaporizes and exits the second vessel through a vapor outlet, causing the biomass fibers to rupture.

In some embodiments, the biomass may be ruptured by adiabatically flashing the biomass material exiting the first vessel. The m first vapor stream may include ammonia and water. The biomass material may include material selected from the group consisting of corn stover, wheat straw, alfalfa, grass, rice straw, corn fiber, distiller's dried grains with solids, switchgrass, bagasse, and mixtures thereof. The first vessel may be pressurizing with a second vapor stream. The second vapor stream may include vaporized swelling agent to a pressure sufficient to prevent vaporization of the liquid swelling agent in the first vessel. The second stream includes vaporized swelling agent recycled from the vapor outlet.

According to some embodiments, the ruptured biomass may be used as a feedstock for an additional process. The additional process may include, for example, forming an alcohol using the biomass material.

According to some embodiments, a method for continuously treating biomass material, may comprise contacting the biomass material and a swelling agent in a first vessel under a pressure at least as great as the vapor pressure of the swelling agent and for a time sufficient to allow the swelling agent to swell fibers within the biomass material; and transferring the biomass material to a second vessel having a pressure sufficiently less than that of the first vessel such that a portion of the swelling agent rapidly vaporizes, causing the biomass fibers to rupture; wherein the first vessel is pressurized with a first stream including vaporized swelling agent to a pressure sufficient to prevent vaporization of the liquid swelling agent in the first vessel.

In some of these embodiments, the method may further comprise drying the biomass material to provide a second vapor stream and a dry biomass; condensing the second vapor stream; and using the condensed second vapor stream to treat the biomass material before the biomass material enters the first vessel. The second vapor stream may include ammonia and water. The second stream may include vaporized swelling agent that is at least partially obtained from the second vessel.

In some embodiments, a method for continuously treating biomass material may comprise contacting the biomass material and a swelling agent in a first vessel under a pressure at least as great as the vapor pressure of the swelling agent and for a time sufficient to allow the swelling agent to swell fibers within the biomass material; transferring the biomass material to a second vessel having a pressure sufficiently less than that of the first vessel such that a portion of the swelling agent rapidly vaporizes, causing the biomass fibers to rupture, providing a ruptured biomass material; pressurizing the first vessel with a first stream including vaporized swelling agent to a pressure sufficient to prevent vaporization of the liquid swelling agent in the first vessel, wherein the first stream includes vaporized swelling agent that is at least partially obtained from the second vessel; drying the ruptured biomass material to provide a second vapor stream and a dried biomass; condensing at least a portion of the second vapor stream; and using the condensed second vapor stream to treat the biomass material before the biomass material enters the first vessel.

According to some embodiments, an apparatus for continuously treating moist biomass material with a swelling agent may comprise a first vessel capable of operating at a pressure greater than an ambient pressure such that the biomass material is in contact with a liquid form of the swelling agent for a sufficient time to swell the biomass material; a second vessel, coupled to the first vessel, and capable of operating at a pressure sufficiently lower than the pressure of the first vessel to allow at least a portion of the swelling agent to vaporize, thereby forming a first vapor stream; and a drying section, coupled to the second vessel and including a dryer, wherein at least a portion of residual moisture and swelling agent may be removed from the biomass, condensed, and recycled.

In some of these embodiments, the apparatus may further comprising a vapor recovery system including a first condenser, coupled to the dryer and capable of condensing the residual moisture and swelling agent removed from the biomass. The first condenser may be coupled directly to the dryer and a first storage tank. The first condenser is coupled to a conveyor upstream of the first vessel.

In some embodiments, the first vessel is an extrusion reactor. The second vessel may be a flash tank capable of operating at a pressure and temperature sufficient to produce a first vapor stream that consists essentially of the swelling agent.

In some embodiments, the apparatus may further comprise a second condenser, capable of condensing the first vapor stream, and a second storage tank capable of receiving the condensed vapor stream. The second storage tank may be capable of storing both liquid swelling agent and gaseous swelling agent. The second storage tank may capable of providing gaseous swelling agent for pressurizing the first vessel, and liquid swelling agent for reacting with the moist biomass.

According to some embodiments, an apparatus for continuously treating biomass material with a swelling agent, may comprise: a first vessel capable of operating at a pressure greater than an ambient pressure wherein the biomass material is in contact with a liquid form of the swelling agent for a sufficient time to swell fibers of the biomass material; a second vessel, coupled to the first vessel, and operated at a pressure sufficiently lower than the pressure of the first vessel to allow at least a portion of the swelling agent to vaporize; and wherein the first vessel is capable of being pressurized by a first stream of vaporized swelling agent.

In some of these embodiments, the second vessel may be a flash tank capable of operating at a pressure and temperature sufficient to produce a second vapor stream that consists essentially of the swelling agent. The first vessel may be capable of being pressurized by swelling agent vapor provided by the second vapor stream.

The apparatus may further comprise a drying section coupled to the second vessel and including a dryer, wherein the drying section is capable of removing at least a portion of residual moisture and swelling agent from the biomass.

The apparatus may also comprise a vapor recovery system including a second condenser, coupled to the dryer and capable of condensing the moisture and swelling agent removed from the biomass. The vapor recovery system may be capable of recycling the condensed moisture and swelling agent to a conveyor upstream of the first vessel.

According to yet other embodiments, an apparatus for continuously treating moist biomass material with a swelling agent may comprise: a first vessel capable of operating at a pressure greater than an ambient pressure wherein the biomass material is in contact with a liquid form of the swelling agent for a sufficient time to swell the biomass material, a second vessel, coupled to the first vessel, and capable of operating at a pressure sufficiently lower than the pressure of the first vessel to allow at least a portion of the swelling agent to vaporize, a connection between an outlet of the second vessel and an inlet of the first vessel capable of providing vaporized swelling agent from the second vessel to the first vessel whereby the first vessel may be pressurized to a pressure sufficient to prevent vaporization of the liquid swelling agent in the first vessel, a drying section coupled to the second vessel and including a dryer and a condenser wherein at least a portion of residual moisture and swelling agent may be removed from the biomass, a vapor recovery system including a first condenser, coupled to the dryer and capable of condensing the moisture and swelling agent removed from the biomass, and wherein the condensed moisture and swelling agent may be used to treat the biomass before entering the first vessel.

What is claimed is:

1. A method for continuously treating biomass material, comprising:

contacting the biomass material and a liquid swelling agent in a first vessel under a pressure sufficient to prevent vaporization of the liquid swelling agent and for a time sufficient to allow the liquid swelling agent to swell fibers within the biomass material; and transferring the biomass material to a second vessel having a pressure sufficiently less than that of the first vessel such that at least a portion of the liquid swelling agent rapidly vaporizes, causing the biomass fibers to rupture;

wherein the first vessel is pressurized by directing a vapor stream including vaporized swelling agent into the first vessel at a pressure sufficient to prevent vaporization of the liquid swelling agent in the first vessel.

2. A method for continuously treating biomass material, comprising:

treating the biomass material with a liquid swelling agent in a first vessel under a pressure sufficient to prevent vaporization of the liquid swelling agent and for a time sufficient to allow the liquid swelling agent to swell fibers within the biomass material; and transferring the treated biomass material to a second vessel having a pressure sufficiently less than that of the first vessel such that at least a portion of the liquid swelling agent rapidly vaporizes, causing the biomass fibers to rupture, wherein the first vessel is pressurized by directing a vapor stream including vaporized swelling agent into the first vessel at a pressure sufficient to prevent vaporization of the liquid swelling agent in the first vessel;

drying the ruptured biomass material to provide a second vapor stream and a dry biomass;

condensing the second vapor stream; and using the condensed second vapor stream to treat the biomass material before the biomass material enters the first vessel.

3. The method of claim 2, wherein the second vapor stream includes ammonia and water.

4. The method of claim 2, wherein the second stream includes vaporized swelling agent that is at least partially obtained from the second vessel.

5. The method of claim 1 or 2, wherein the ruptured biomass is dried under partial vacuum.

* * * * *

UNITED STATES PATENT AND TRADEMARK OFFICE

CERTIFICATE OF CORRECTION

PATENT NO. : 7,937,851 B2
APPLICATION NO. : 11/719158
DATED : May 10, 2011
INVENTOR(S) : Rajagopalan et al.

It is certified that error appears in the above-identified patent and that said Letters Patent is hereby corrected as shown below:

The Title page;

The Title page, showing the illustrative figure, should be deleted and substitute therefor the attached Title page.

Title page, Section (57), Abstract, line 6: "At least portions the swelling agent," should read -- "At least portions of the swelling agent,"

Delete figs. 1-5 and substitute therefor the drawing sheets, consisting of figs. 1-5 as shown on the attached page.

Column 2, line 20: "increase the availability of cellulosic and other materials are described." should read -- "increase the availability of cellulosic and other materials."
Column 5, line 39: "includes feeder 42, dryer 44" should read -- "includes feeder 43, dryer 44"
Column 5, line 41: "carried by feeder 42 to dryer 44" should read -- "carried by feeder 43 to dryer 44"
Column 6, line 22: "may be stored a temperature about the operating temperature" should read -- "may be stored at about the operating temperature"
Column 6, line 30: "liquid swelling agent of stream 42" should read -- "liquid swelling agent of stream 40"
Column 6, line 31: "70 to reactor 34 to transition chamber 32." should read -- "70 to transition chamber 32."
Column 6, line 57: "include feeder 42, dryer" should read -- "include feeder 43, dryer"
Column 6, line 59: "dryer 44 by conveyor 42" should read -- "dryer 44 by conveyor 43"
Column 7, line 12: "and tank 82." should read -- "and tank 88."
Column 7, line 17: "may be placed in tank 82." should read -- "may be placed in tank 88."
Column 7, line 17: "outlet of tank 82 to an inlet" should read -- "outlet of tank 88 to an inlet"
Column 7, line 20: "flow from tank 82" should read -- "flow from tank 88"
Column 7, line 21: "presoak conveyor 24 (shown in FIG. 2)." should read -- "presoak (conveyor shown in FIG. 1)."

Signed and Sealed this
Tenth Day of April, 2012

David J. Kappos

David J. Kappos
*Director of the United States Patent and Trademark Office*

Column 7, line 40: “pressure of 20 atm” should read -- “pressure of 13 atm”
Column 8, line 3: “a pressure of 20 atm” should read -- “a pressure of 13 atm”
Column 8, line 44: “The m first vapor stream” should read -- “The first vapor stream”
Column 9, line 46: “apparatus may further comprising” should read -- “apparatus may further comprise”

(12) United States Patent
Rajagopalan et al.

(10) Patent No.: US 7,937,851 B2
(45) Date of Patent: May 10, 2011

(54) PROCESS FOR TREATMENT OF BIOMASS FEEDSTOCKS

(75) Inventors: Srinivasan Rajagopalan, Lansing, MI (US); Tonya Tiedje, Holt, MI (US); Darold McCalla, East Lansing, MI (US)

(73) Assignee: Michigan Biotechnology Institute, Lansing, MI (US)

( * ) Notice: Subject to any disclaimer, the term of this patent is extended or adjusted under 35 U.S.C. 154(b) by 180 days.

(21) Appl. No.: 11/719,158

(22) PCT Filed: Nov. 9, 2005

(86) PCT No.: PCT/US2005/040540
§ 371 (c)(1),
(2), (4) Date: May 11, 2007

(87) PCT Pub. No.: WO2006/055362
PCT Pub. Date: May 26, 2006

(65) Prior Publication Data

US 2009/0098251 A1 Apr. 16, 2009

Related U.S. Application Data

(60) Provisional application No. 60/627,259, filed on Nov. 12, 2004.

(51) Int. Cl.
*F26B 3/00* (2006.01)
*F26B 21/06* (2006.01)

(52) U.S. Cl. ..... 34/357; 34/405; 34/470

(58) Field of Classification Search ..... 34/329, 34/357, 405, 406, 407, 467, 468, 470, 72, 34/73, 92

See application file for complete search history.

(56) References Cited

U.S. PATENT DOCUMENTS

| | | | | |
|---|---|---|---|---|
| 4,356,196 | A | 10/1982 | Hultquist | |
| 5,171,592 | A | 12/1992 | Holtzapple et al. | |
| 6,106,888 | A | 8/2000 | Dale et al. | |
| 6,176,176 | B1 | 1/2001 | Dale et al. | |
| 6,255,505 | B1 * | 7/2001 | Bijl et al. | 554/227 |

FOREIGN PATENT DOCUMENTS

EP 1533279 A1 * 5/2005

* cited by examiner

*Primary Examiner* — Jiping Lu
(74) *Attorney, Agent, or Firm* — Dickinson Wright PLLC

(57) ABSTRACT

A method and apparatus for continuously treating a moist biomass feedstock is disclosed. The method includes treating a biomass feedstock with a swelling agent in a pressurized first vessel, transferring the feedstock to a second vessel at a lower operating pressure than the first vessel such that the biomass fibers rupture. At least portions the swelling agent, and/or the moisture are recycled in the process.

5 Claims, 3 Drawing Sheets

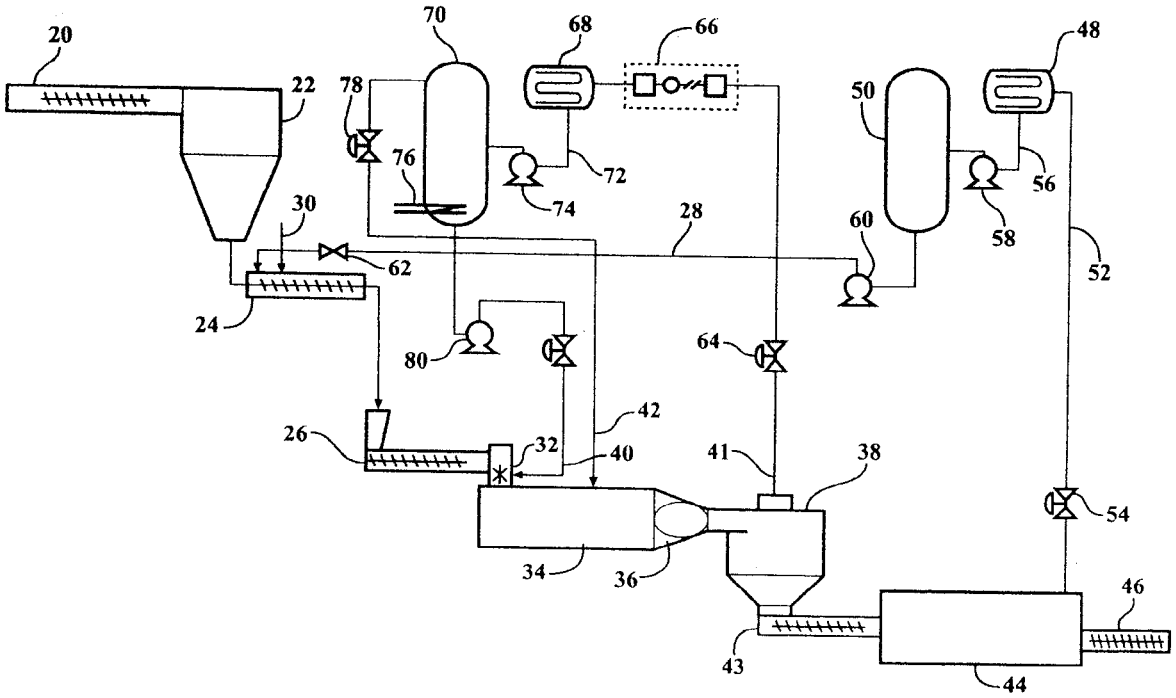

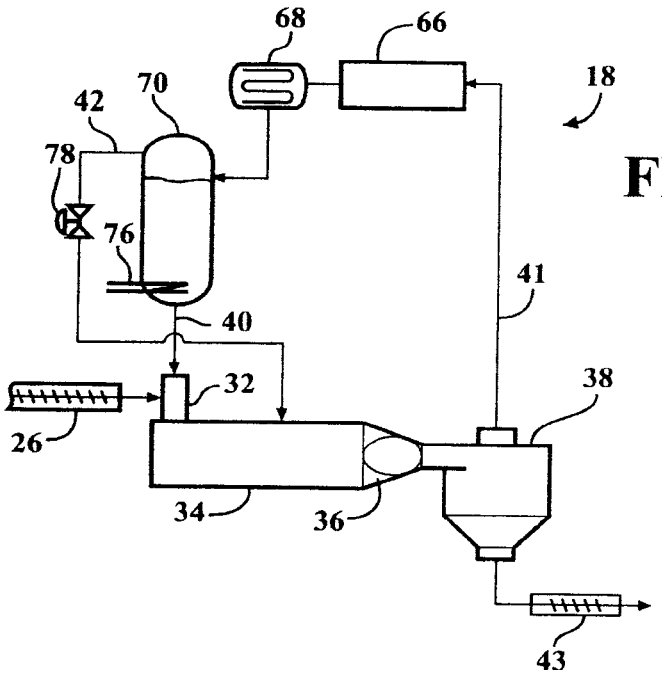
FIG. 2
FIG. 3
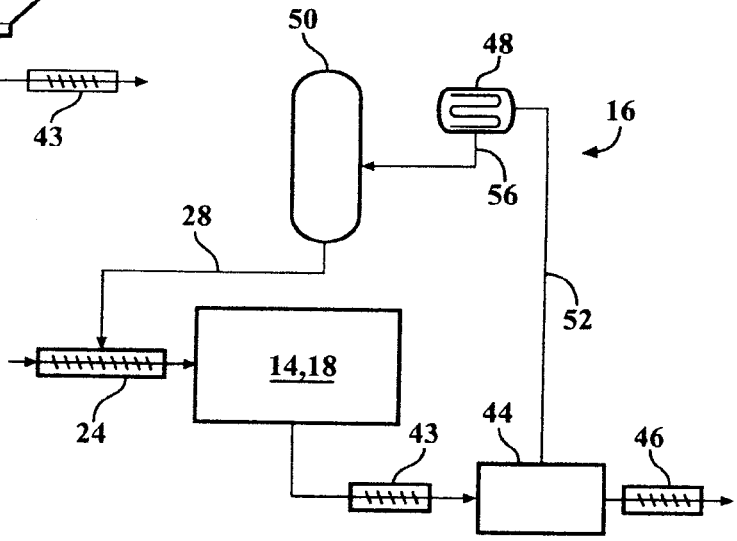
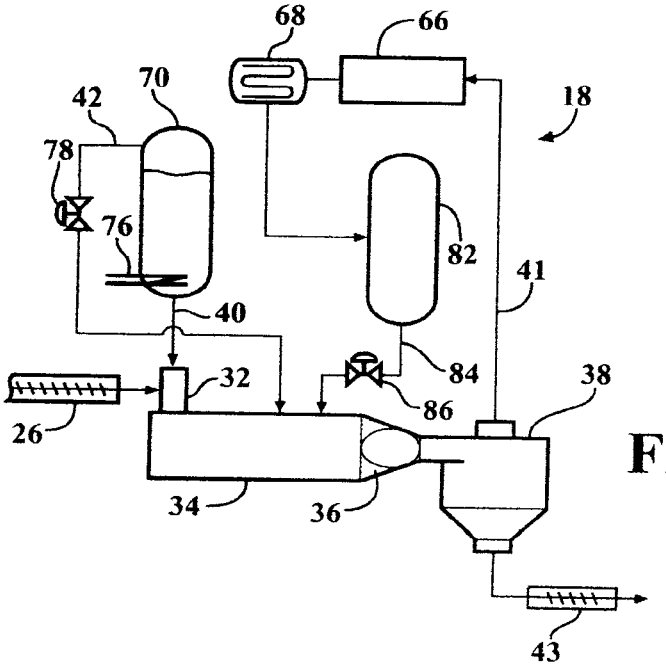
FIG. 4